US005912215A

United States Patent [19]

Sapienza et al.

[11] Patent Number: 5,912,215

[45] Date of Patent: Jun. 15, 1999

[54] FOOD GRADE DIELECTRIC FLUID

[75] Inventors: Richard Sapienza, Shoreham; Robert Silverstein, Great Neck, both of N.Y.

[73] Assignee: Electric Fluids, LLC., Plainview, N.Y.

[21] Appl. No.: 08/951,392

[22] Filed: Oct. 16, 1997

[51] Int. Cl.[6] ..... H01F 27/12; H01B 3/22

[52] U.S. Cl. ..... 508/584; 336/58; 336/94; 252/570; 252/578

[58] Field of Search ..... 252/570, 578; 336/58, 94; 508/584

[56] References Cited

U.S. PATENT DOCUMENTS

| | | | |
|---|---|---|---|
| 4,033,854 | 7/1977 | Ohmori et al. | 208/14 |
| 4,072,620 | 2/1978 | Masunaga et al. | 252/63 |
| 4,082,866 | 4/1978 | Link | 427/294 |
| 4,284,522 | 8/1981 | Olmsted | 585/6.6 |
| 4,530,782 | 7/1985 | Meyer | 252/578 |
| 5,766,517 | 6/1998 | Goedde et al. | 252/570 |

*Primary Examiner*—Jerry D. Johnson
*Attorney, Agent, or Firm*—Hedman, Gibson & Costigan, P.C.

[57] ABSTRACT

A food grade, biodegradable dielectric composition and method for preparation thereof, comprising an unsaturated hydrocarbon alone, or in a blend with a food grade natural or synthetic hydrocarbon, which has been processed to remove polar contaminants and further including an anti-oxidant additive is disclosed.

20 Claims, No Drawings

FOOD GRADE DIELECTRIC FLUID

This invention relates to a novel composition for a food grade, biodegradable dielectric fluid and to a process for the manufacture of the fluid.

BACKGROUND OF THE INVENTION

Dielectric fluids are often used in transformers, electrical switch gears, self-contained and pipe type cables and other pieces of equipment that require fluids that are generally fire and oxidation resistant and which include moderately good heat transfer characteristics and electrical properties. These dielectric fluids, however, are often limited in their use to, for example, equipment that is compatible with a more highly viscous fluid. These materials are not biodegradable and represent a potential environmental hazard if they leak or are accidentally spilled.

Moreover, these prior art dielectric fluids generally are not eligible for the "food grade" classification given by having USDA H1 approval and meeting the requirements under FDA regulation 21 CFR 178.3620(b) and having no PCB (poly chlorinated biphenyls), free benzene or polynuclear aromatics present.

Therefore it is desirable to develop and qualify a non-toxic biodegradable/-environmentally friendly dielectric fluid that would act as a direct replacement to these fluids. The new fluids must meet the rigid performance specifications of the current fluids (e.g. viscosity, color, water content, dielectric strength, and power factor) and must be able to operate over the temperature range of from about −50 to about 100° C.

Some of the above inadequacies of the prior art dielectric fluids may be attributed to the fact that it was thought that a wide range of molecular weight species in the fluid was desirable. This conventional wisdom is exemplified in U.S. Pat. No. 4,284,522 (the '522 patent), which discloses a composition and method for forming a dielectric fluid composition wherein natural and synthetic hydrocarbons of different molecular weights are selectively blended to achieve a flat molecular weight distribution. According to the '522 patent, a wide molecular weight distribution improved the physical and chemical properties of the dielectric fluid. However, while a wide range of molecular weight compounds may have improved certain characteristics of the fluid, it also adversely affected various other physical and chemical parameters of the fluid in that, for example, it impeded the flow properties of the fluid composition.

In another disclosure of dielectric fluids, U.S. Pat. No. 4,082,866, it is taught that compounds having terminal olefinic bonds should be avoided. In U.S. Pat. No. 4,033,854 it was taught that a highly refined oil will not exhibit properties required of a dielectric fluid unless an aromatic hydrocarbon is added. Similarly, U.S. Pat. No. 4,072,620 taught the need for aromatic compounds to keep hydrogen gas absorbency at satisfactory levels which may be an indicator of corona resistance. The presence or addition of aromatics would not allow these materials to qualify as food grade.

SUMMARY OF THE INVENTION

Accordingly it is an object of the present invention to provide a novel process for the manufacture of a food grade, biodegradable dielectric fluid.

It is another object of the present invention to provide a novel food grade, biodegradable dielectric fluid that exhibits a low viscosity at the temperature of use.

It is still another object of the present invention to provide a novel food grade, biodegradable dielectric fluid that exhibits improved heat transfer characteristics and excellent electrical properties.

It is another further object of the present invention to provide a novel food grade, biodegradable dielectric fluid that includes a raised hydrocarbon gas absorbency.

It is yet another object of the present invention to provide a novel food grade, biodegradable dielectric fluid that may be used in equipment designed to be used with conventional dielectric fluids.

It is a still another further object of the present invention to provide a novel food grade biodegradable dielectric fluid that is economically feasible to produce.

The objectives and advantages of the present invention are achieved, in a preferred embodiment, by providing a composition and method that involves the use of unsaturated (that is, unhydrogenated) polyalphaolefins containing at least about 50% olefinic character or normal alpha olefins and their isomers, particularly higher weight fractions. These compounds have typically been used previously as reactive olefin intermediates and contain terminal olefinic bonds. Because the materials remain liquid at temperatures well below 0° C. they are useful in making derivatives whose low temperature flow properties are critical.

However, the present inventors have noted that these compounds also possess low viscosity, low pour point and promising negative outgassing tendencies indicating that these compounds would surprisingly be suitable basestocks useful for blending into dielectric fluids having significantly improved properties. Further, the food grade specification testing, i.e, Saybolt color minimum and ultraviolet absorbance limits as defined by the FDA regulation 21 CFR 178.3620(b), are also met by these commercially available materials. Further contributing to their use as a component for a dielectric fluid, these non-toxic, food grade, biodegradable fluids have also been shown to have a low power factor, excellent resistance to gassing under electrical stress, high water tolerance, no pumping problems and are compatible with polybutene, alkylbenzenes or mineral oil.

Blends of previously described olefins and refined oils can also be utilized in the practice of the present invention. The percentage of each type of molecule in the fluid is not critical provided the resulting mixture possesses the desirable flow properties and good dielectric properties. The only requirement of these additional components is that added refined oil must have USDA H1 authorization and be sanctioned by the FDA under 21 CFR 178.3620 and may be used under 21 CFR. Exemplary, but not exhaustive, of these types of oils include, but are not limited to, natural and synthetic hydrocarbons such as low viscosity hydrogenated polyalphaolefins (PAO), technical grade white mineral oils and others in which processing removes at least substantially all, if not all undesirable aromatics and eliminates at least substantially all of the sulfur, nitrogen and oxygen compounds.

In general, these materials can be blended and compounded in a wide range of lubricants as additive diluent and as a component and make for a fluid with improved compatibility with conventional hydrocarbon dielectric fluids. They are clear and bright and contain no aromatics making them non-toxic with low misting and very low temperature fluidity and very fast water separation.

It should be clear to those skilled in the art that the olefins alone or the blends described above can also be blended with food grade polybutenes to create a low pour point fluid with outstanding hydrogen gas absorbency.

Polar contaminants are removed from the unsaturates or the blends by contacting them with an adsorbent medium, as is known to those of ordinary skill in the art. The contacting process can be accomplished with either an adsorbent medium in the form a slurry or by subjecting the effluent to a percolation-type apparatus. Subsequent to the contacting process, the fluid is fortified with antioxidant additives.

Thus, the composition and process of manufacturing same has numerous advantages over the prior art dielectric fluids. First, the composition and process therefor, raises the hydrogen gas absorbency of the resulting fluid and renders it usable as a dielectric fluid classified as "food grade" by the USDA H1 authorization. Second, the inventive composition, and process therefor, further maintains a lower viscosity of the fluid at use temperatures than is presently available with either petroleum products or polybutene fluids. This lower viscosity allows the use of the inventive fluid in cables and other electrical equipment that have been designed for use with conventional fluids such as alkylbenzenes. Third, the inventive composition, and process therefor, results in a dielectric fluid having a high dielectric strength and low dissipation loss.

DETAILED DESCRIPTION OF THE PRESENT INVENTION

The present invention contemplates preparing a food grade, biodegradable dielectric fluid having a low viscosity and a pour point below about −15° C. The dielectric fluid will have a high dielectric strength and a low dissipation loss. Generally, the dielectric fluid is prepared from a commercial unsaturated hydrocarbon, i.e., a synthetically derived hydrocarbon having a narrow range of molecular weight hydrocarbons or normal alpha olefins and their isomers, particularly the higher weight fractions used for metal working fluids, i.e., $C_{14}$, $C_{16}$ and $C_{18}$ hydrocarbons, which have had at least substantially all, if not all, of the polar contaminants removed therefrom, such as by contacting with an adsorbent medium. To this material is added a food grade saturated or unsaturated hydrocarbon selected from food grade saturated hydrocarbons such as technical white oils or saturated polyalphaolefins and/or a commercial unsaturated hydrocarbon such as a normal alpha olefin. Then added to the processed hydrocarbons is an antioxidant.

The dielectric fluid is generally biodegradable and is prepared from commercially available natural petroleum-derived unsaturated paraffin hydrocarbons. One of the hydrocarbons suitable for use herein was purchased from Chevron and was identified as Synfluid Dimer C10, a dimer of decene. It should be clear to those knowledgeable in the state of the art that any of the lower molecular weight unsaturated polyalphaolefins ($C_{16}$–$C_{24}$) alone or in a mixture could be utilized. Another group suitable for use herein are the Gulftenes from Chevron, specifically the $C_{14}$–$C_{18}$.

These commercial hydrocarbons are processed with an appropriate adsorbent medium known to those of ordinary skill in the art, i.e., Fullers Earth, to remove polar contaminants. The contacting process can be accomplished with either an adsorbent medium in the form of a slurry, or by subjecting the effluent to a percolation-type apparatus. Similarly any other process known to those skilled in the art for removing at least substantially all of the polar contaminants could be employed without departing from the scope of the present invention.

After removing the polar contaminants, the treated olefinic petroleum effluent is fortified with food grade antioxidant additives. The antioxidants used in the practice of the present invention are any of the known antioxidants for dielectric fluids. The preferred antioxidants are the hindered phenols which are used at concentrations of less than about 2.0% by volume and preferably between about 0.05% and about 0.50% by volume.

The hindered phenolic compound is preferably 2,6-di-tert-butylated paracresol. Alternatively, any one of the number of related compounds which are food grade may be used which have the ability to increase the oxidation stability of petroleum and/or synthetic oils. Examples of commercially available oxidation inhibitors which may be used herein include, but are not limited to, Tenox BHT, manufactured by Eastman Chemical Company, Kingsport, Tenn., and CAO-3 manufactured by PMC Specialties, Fords, N.J.

The antioxidant additives are generally added with the saturated component, a polyalphaolefin (PAO) or a technical white oil, when the saturated components are added to the olefin. The preferred biodegradable PAO's are the low molecular weight oligomers of alpha-decene (mainly dimers to tetramers). The low molecular weight is a benefit at low temperatures where PAO's demonstrate excellent performance and they make good blending stocks with excellent hydrolytic stability. Oxidative stability of antioxidant containing PAO's is very comparable to petroleum-based products.

The technical white oils useful in the practice of the present invention are produced by the latest technology in refinery processes known to those skilled in the art such as a multi-stage hydrotreating process operating at high pressure, or a combination of single or two-stage hydrocracking with dewaxing or hydroisomerization followed by severe hydrotreating. Either of these process provides for outstanding product purity. This processing converts all undesirable aromatics into desirable paraffinic and cycloparaffinic hydrocarbons and completely eliminates sulfur, nitrogen and oxygen compounds. These materials have very good low temperature fluidity and very fast water separation. One of the materials useful in the practice of the present invention is a commercial white oil from Calumet sold under the trade name Caltech 60.

The final product manufactured according to the process of the present invention will exhibit a pour point (per ASTM standard method D97) of below −15° C. The fluid will have a high dielectric strength of greater than about 30 Kv and preferably greater than about 35 Kv; and low dissipation loss at 25° C. of less than about 0.01% and preferably less than about 0.008%, and at 100° C. less than about 0.30% and preferably less than about 0.25%; and a viscosity of less than about 15 cSt at 40° C.

DESCRIPTION OF THE PREFERRED EMBODIMENTS

The following examples illustrate the present invention. They are not to be construed to limit the claims in any manner whatsoever.

The following table lists the properties of the oils utilized in the Examples.

TABLE 1

| Component | Pour Point ° C. | Viscosity @40° C., cSt | Viscosity @100° C., cSt | Flash Point COC | Food Grade | Gassing Character ASTM-2300B | Color, Saybolt | Biode-gradable |
|---|---|---|---|---|---|---|---|---|
| Dodecylbenzene | −50° C. | 4.30–7.37 | <2.2 | >130° C. | No | −30 μl/min | +29 | Yes |
| Technical white Oil (Caltech 60) | −65° C. | 9.5 | 2.4 | 143° C. | Yes | +34 μl/min | +30 | Yes |
| Unsaturated PAO decene diner (Chevron $C_{10}$ dimer) | −73° C. | 4.9 | 1.7 | 161° C. | Yes | −38.1 μl/min | +30 | Yes |
| Unsaturated n-alpha olefin (Chevron Gulftene 14) | −13° C. | 1.85 | 0.89 | 107° C. | Yes | −80 μl/min | +30 | Yes |
| Polybutene Amoco L10 | −50° C. | 23.3 | 3.8 | 141° C. | Yes | −58.5 μl/min | +28 | No |

EXAMPLE 1

A biodegradable, food grade dielectric fluid was prepared from a natural petroleum-derived unsaturated hydrocarbon purchased from Chevron. The decene dimer material containing 67% olefins (this represents a pure mixture of unsaturated and saturated PAO) with a pour point of −73° C. was treated by contacting with Fullers Earth to remove polar contaminants and any peroxides. The adsorbent medium was in a percolation-type apparatus.

The following tests were then performed on the dielectric fluid to verify its superior heat transfer characteristics.

| Test | Result |
|---|---|
| Appearance | No visible particulate |
| Dielectric Breakdown | 48 Kv |
| Dissipation Factor | |
| @100° C. | 0.071% |
| Dielectric Constant | ~2 |
| Moisture content | 20 ppm |
| PCB content | none detectable |
| Acid number | <0.01 Mg KOH/g |
| Pour Point | −73° C. |
| Flash Point | 161° C. |
| Viscosity | |
| @40° C. | 4.9 cSt |
| @100° C. | 1.68 cSt |
| Specific Gravity | .802 |
| Gassing Tendency | −38 μl/min |

EXAMPLE 2

A blend of 60% of the olefin from Example 1 and 40% of a technical white oil from Calumet described as Caltech 60 was prepared and treated by contacting with Fullers Earth in a percolation-type apparatus to remove polar contaminants and any peroxides. The following tests were then performed on the dielectric fluid to verify its excellent heat transfer characteristics.

| Test | Result |
|---|---|
| Appearance | No visible particulate |
| Dielectric Breakdown | 40 Kv |
| Dissipation Factor | |
| @100° C. | 0.014% |
| Dielectric Constant | ~2 |
| Moisture content | 20 ppm |

-continued

| Test | Result |
|---|---|
| PCB content | none detectable |
| Acid number | <0.01 Mg KOH/g |
| Pour Point | −65° C. |
| Flash Point | 153° C. |
| Viscosity | |
| @40° C. | 5.88 cSt |
| @100° C. | 2.04 cSt |
| Specific Gravity | 0.835 |
| Gassing Tendency | −20 μl/min |

EXAMPLE 3

A blend of 40% of the olefin from Example 1 and 60% of a tech white oil from Calumet described as Caltech 60 was prepared and treated by contacting with Fullers Earth in a percolation-type apparatus to remove polar contaminants and any peroxides. The following tests were then performed on the dielectric fluid to verify its excellent heat transfer characteristics.

| Test | Result |
|---|---|
| Appearance | No visible particulate |
| Dielectric Breakdown | 50.4 Kv |
| Dissipation Factor | |
| @100° C. | 0.058% |
| Dielectric Constant | ~2 |
| Moisture content | 20 ppm |
| PCB content | none detectable |
| Acid number | <0.01 Mg KOH/g |
| Pour Point | <−65° C. |
| Flash Point | 150° C. |
| Viscosity | |
| @40° C. | 6.76 cSt |
| @100° C. | 1.999 cSt |
| Specific Gravity | 0.853 |
| Gassing Tendency | −6 μl/min |

EXAMPLE 4

A biodegradable, food grade dielectric fluid was prepared from a natural petroleum-derived unsaturated hydrocarbon purchased from Chevron. The normal alpha olefin material containing 92.0% min. olefins content with a pour point of 7° C. and was treated by contacting with an absorbent medium, such as Fullers Earth to remove polar contaminants and any peroxides. The adsorbent medium was in a percolation-type apparatus. The following properties were determined.

| Test | Result |
|---|---|
| Appearance | No visible particulate |
| Dielectric Breakdown | 54 Kv |
| Dissipation Factor | |
| @100° C. | 0.023% |
| Moisture content | 20 ppm |
| PCB content | none detectable |
| Acid number | <0.01 Mg KOH/g |
| Pour Point | <−7° C. |
| Flash Point | 132° C. |
| Viscosity | |
| @40° C. | 2.82 cst |
| @100° C. | 1.149 cSt |
| Specific Gravity | 0.785 |

EXAMPLE 5

A blend of 30% of the olefin from example 4 and 70% of a tech white oil from Calumet described as Caltech 60 was prepared and treated by contacting with Fullers Earth in a percolation-type apparatus to remove polar contaminants and any peroxides. The following tests were then performed on the dielectric fluid to verify its excellent heat transfer characteristics.

| Test | Result |
|---|---|
| Appearance | No visible particulate |
| Dielectric Breakdown | 42 Kv |
| Dissipation Factor | |
| @100° C. | 0.025% |
| Moisture content | 20 ppm |
| PCB content | none detectable |
| Acid number | <0.01 Mg KOH/g |
| Pour Point | −21° C. |
| Flash Point | 140° C. |
| Viscosity | |
| @40° C. | 5.75 cSt |
| @100° C. | 1.843 cSt |
| Specific Gravity | 0.856 |
| Gassing Tendency | −46 μl/min |

EXAMPLE 6

A biodegradable, food grade dielectric fluid was prepared from a natural petroleum-derived unsaturated hydrocarbon purchased from Chevron. The normal alpha olefin material containing 93.0% min. olefins content with a pour point of −12.2° C. and was treated by contacting with an absorbent medium, such as Fullers Earth to remove polar contaminants and any peroxides. The adsorbent medium was in a percolation-type apparatus. The following properties were determined.

| Test | Result |
|---|---|
| Appearance | No visible particulate |
| Dielectric Breakdown | 58 Kv |
| Dissipation Factor | |
| @100° C. | 0.024% |
| Dielectric Constant | ~2 |

-continued

| Test | Result |
|---|---|
| Moisture content | 20 ppm |
| PCB content | none detectable |
| Acid number | <0.01 Mg KOH/g |
| Pour Point | −12.2° C. |
| Flash Point | 107° C. |
| Viscosity | |
| @40° C. | 1.85 cSt |
| @100° C. | 0.891 cSt |
| Specific Gravity | 0.775 |

EXAMPLE 7

A blend of 20% of the olefin from Example 6 and 80% of a tech white oil from Calumet described as Caltech 60 was prepared and treated by contacting with Fullers Earth in a percolation-type apparatus to remove polar contaminants and any peroxides. The following tests were then performed on the dielectric fluid to verify its excellent heat transfer characteristics.

| Test | Result |
|---|---|
| Appearance | No visible particulate |
| Dielectric Breakdown | 50.2 Kv |
| Dissipation Factor | |
| @100° C. | 0.039% |
| Dielectric Constant | ~2 |
| Moisture content | 20 ppm |
| PCB content | none detectable |
| Acid number | <0.01 Mg KOH/g |
| Pour Point | −43° C. |
| Flash Point | 140° C. |
| Viscosity | |
| @40° C. | 6.075 cSt |
| @100° C. | 1.873 cSt |
| Specific Gravity | 0.864 |
| Gassing Tendency | −78 μl/min |

The foregoing description is for purposes of illustration, rather than limitation of the scope of protection according this invention. The latter is to be measured by the following claims, which should be interpreted as broadly as the invention permits. Many variations of the present invention will suggest themselves to those skilled in the art in light of the above-detailed description. For example, an antioxidant, such as a 2,6-di-tert-butyl para-cresol, can be added to the dielectric composition. All such obvious modifications are within the full intended scope of the appended claims.

The above-referenced patents, regulations and test methods are hereby incorporated by reference.

We claim:

1. An electrical apparatus employing an insulating oil wherein said insulating oil comprises a food grade, biodegradable unsaturated hydrocarbon having at least about 50% olefinic character and which is substantially free of polar contaminants.

2. An electrical apparatus as defined in claim 1 wherein said insulating oil further comprises an antioxidant.

3. An electrical apparatus as defined in claim 2 wherein said antioxidant comprises a hindered phenolic compound.

4. An electrical apparatus as defined in claim 3 wherein said hindered phenolic compound comprises 2,6-di-tert-butyl-p-cresol.

5. An electrical apparatus as defined in claim 3 wherein the amount of hindered phenol added to said unsaturated hydrocarbon ranges from about 0.05 to about 0.5% by volume.

6. An electrical apparatus as defined in claim 1 wherein said insulating oil further comprises a food grade, biodegradable saturated hydrocarbon.

7. An electrical apparatus as defined in claim 6 wherein said food grade, biodegradable saturated hydrocarbon is selected from the group of a technical white oil, a saturated polyalphaolefin, and mixtures thereof.

8. An electrical apparatus as defined in claim 7 wherein the amount of said saturated hydrocarbon added to said insulating oil ranges from about 30 to about 90 percent by weight.

9. An electrical apparatus as defined in claim 1 wherein said insulating oil has negative outgassing tendency.

10. An electrical apparatus as defined in claim 1 wherein said electrical apparatus is selected from the group consisting of transformers, electrical switch gears and electrical cables.

11. An electrical apparatus as defined in claim 1 wherein said unsaturated hydrocarbon is selected from the group consisting of dimers, trimers and tetramers of alpha decene and mixtures thereof.

12. An electrical apparatus as defined in claim 1 wherein said unsaturated hydrocarbon comprises a petroleum-derived hydrocarbon.

13. An electrical apparatus as defined in claim 1 wherein said insulating oil has a pour point of less than about −15° C.

14. An electrical apparatus as defined in claim 1 wherein said insulating oil has a dielectric strength of greater than about 35 Kv, a dissipation loss of less than about 0.008% at 25° C. and less than about 0.25% at 100° C., and a viscosity of less than about 15 cSt at 40° C.

15. An electrical apparatus as defined in claim 1 wherein said unsaturated hydrocarbon substantially free of polar contaminants is prepared by contacting said unsaturated hydrocarbon with an adsorbent medium.

16. An electrical apparatus as defined in claim 15 wherein said adsorbent medium comprises Fullers earth.

17. An electrical apparatus as defined in claim 15 wherein said contacting comprises contacting in a slurry or in a percolating apparatus.

18. An electrical apparatus as defined in claim 1 wherein said unsaturated hydrocarbon comprises terminal olefinic groups.

19. An electrical apparatus as defined in claim 1 wherein said food grade, biodegradable unsaturated hydrocarbon comprises one or more $C_{14}$–$C_{24}$ normal alpha olefins.

20. An electrical apparatus employing an insulating oil wherein said insulating oil comprises a food grade, biodegradable normal alpha olefin which is substantially free of polar contaminants.

* * * * *